US008210524B2

(12) United States Patent
Uchida

(10) Patent No.: US 8,210,524 B2
(45) Date of Patent: Jul. 3, 2012

(54) IMAGE FORMING APPARATUS

(75) Inventor: Yasuhiro Uchida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 964 days.

(21) Appl. No.: 12/190,324

(22) Filed: Aug. 12, 2008

(65) Prior Publication Data

US 2009/0057975 A1 Mar. 5, 2009

(30) Foreign Application Priority Data

Aug. 31, 2007 (JP) ..... 2007-226362

(51) Int. Cl.
*B65H 1/00* (2006.01)

(52) U.S. Cl. ..... 271/164; 271/162

(58) Field of Classification Search ..... 271/145, 271/162, 164
See application file for complete search history.

(56) References Cited

U.S. PATENT DOCUMENTS

| | | | | |
|---|---|---|---|---|
| 4,540,169 | A * | 9/1985 | Levinson | 271/127 |
| 5,013,025 | A * | 5/1991 | Arai et al. | 271/164 |
| 5,145,166 | A * | 9/1992 | Neudecker et al. | 271/164 |
| 5,292,116 | A * | 3/1994 | Inoue et al. | 271/157 |
| 5,364,088 | A * | 11/1994 | Maruyama et al. | 271/164 |
| 5,413,409 | A * | 5/1995 | Arai | 312/330.1 |
| 2006/0202406 | A1 * | 9/2006 | Kobayashi | 271/162 |
| 2006/0237898 | A1 * | 10/2006 | Mizobe | 271/147 |
| 2008/0111295 | A1 * | 5/2008 | Tanaka et al. | 271/164 |

FOREIGN PATENT DOCUMENTS

JP 11-301861 A 11/1999

* cited by examiner

*Primary Examiner* — Kaitlin Joerger
*Assistant Examiner* — Patrick Cicchino
(74) *Attorney, Agent, or Firm* — Fitzpatrick, Cella, Harper & Scinto

(57) ABSTRACT

The inclination in the sliding direction to an inner rail of the sheet cassette is limited by a swing lever which is provided at a roller bearing support member so as to be protruded through the side of the upper guide surface of the inner rail when the sheet cassette is moved and the limitation of the inclination of the sheet cassette by the swing lever is released when the sheet cassette is pulled out.

4 Claims, 8 Drawing Sheets

IMAGE FORMING APPARATUS

BACKGROUND OF THE INVENTION

1. Field of the Invention

The present invention relates to an image forming apparatus, particularly the image forming apparatus formed so that a sheet cassette is drawably mounted onto a cassette housing portion formed in a main body of the image forming apparatus.

2. Description of the Related Art

An example of image forming apparatuses such as conventional facsimile machines, copying machines, and printers includes an image forming apparatus which is formed so that the sheet cassette which houses the sheet is drawably mounted onto the cassette housing portion formed in the main body of the image forming apparatus. In such an image forming apparatus, the sheet housed in the sheet cassette is sequentially conveyed to an image forming portion at the time of image formation and images are formed on the sheet in the image forming portion.

The conventional image forming apparatuses have a drawer apparatus which drawably mounts the sheet cassette. FIG. 6 illustrates the structure of such a drawer apparatus.

The drawer apparatus is formed opposite to the inner wall surface of the cassette housing portion of the main body of the image forming apparatus (not shown) and has a frame rail 20 which is a guide when a sheet cassette 2 is pulled out. Further, the drawer apparatus is formed on the wall surface of both sides of the sheet cassette 2 opposite to the frame rail 20 and has a cassette rail 3 which is a guide when the sheet cassette 2 is pulled out.

The frame rail 20 includes an outer rail 7 fixed to the inner wall surface of the cassette housing portion, an inner rail 8 which is slidably held by the outer rail 7 and in which a locking member 9 is formed in a downstream end in a pull out direction illustrated by an arrow (hereinafter referred to as pull out direction). When the sheet cassette 2 is moved, the cassette rail 3 which is an engaging portion is engaged with the inner rail 8 which is a rail member. Then, both rails are moved along the inner rail 8 while the movement of the sheet cassette 2 in a sliding direction is regulated.

A roller bearing member 10 which rotates on an axis 10*a* along the cassette rail 3 of the sheet cassette 2 is formed in the downstream end of the inner rail 8 in the pull out direction so as to allow the sheet cassette 2 to be pulled out smoothly. In order to allow the sheet cassette 2 to be pulled out smoothly, rotating roller bearing members 4 and 5 are formed on the wall surface of both sides of the sheet cassette 2 along an upper guide surface 8*a* of the inner rail 8 and a lower guide surface 8*b*.

The roller bearing members 4 and 5 are rotatably held by fixed shafts 4*a* and 5*a* provided at a roller bearing support member 6 which has a part of the cassette rails 3. A locking claw 11 which is locked by the locking member 9 of the inner rail 8 when the sheet cassette 2 is pulled out is formed in the downstream end of the roller bearing support member 6 in the pull out direction.

In such a drawer apparatus, when the sheet cassette 2 is pulled out, for example, for housing the sheet, the locking claw 11 which is a drawer stop portion provided at the roller bearing support member 6 is locked by the locking member 9 which is a stop portion formed on the lower guide surface 8*b* of the inner rail 8 as shown in FIG. 7. Further, when the sheet cassette 2 is pulled out, the sheet cassette 2 slides integrally with the inner rail 8 along the outer rail 7 under the condition that the locking claw 11 is locked by the locking member 9.

Thus, the sheet cassette 2 is pulled out while the inner rail 8 is integrally pulled out. Thereafter, a stopper (not shown) which is provided at the inner rail 8 is locked by the outer rail 7, which allows the sheet cassette 2 to be stopped in the condition that the inner rail 8 is pulled out. The sheet can be housed in the sheet cassette without separating from the main body of the image forming apparatus by pulling out the sheet cassette 2 in such a manner.

When the sheet cassette 2 is detached from the main body of the image forming apparatus, the downstream of the sheet cassette 2 in the pull out direction is lifted upward in the condition that the sheet cassette 2 is pulled out from the main body of the image forming apparatus as shown in FIG. 8. Thus, the engagement of the locking claw 11 of the sheet cassette 2 and the locking member 9 of the inner rail 8 is separated. The sheet cassette 2 can be detached (drawn out) from the main body of the image forming apparatus by pulling out the sheet cassette 2 under the condition.

Here, an abutting portion 11*a* against the locking member 9 of the locking claw 11 of the roller bearing support member 6 (shown in FIG. 8) and an abutting portion 9*a* against the locking claw 11 of the locking member 9 of the inner rail 8 are inclined so as to guide the movement in a take out direction of the sheet cassette 2, namely, the movement obliquely upward. Thus, in taking out the sheet cassette 2, when the downstream of the sheet cassette 2 in the pull out direction is lifted, the sheet cassette 2 is lifted obliquely upward while being guided by the inclination of the abutting portion 11*a* of the locking claw 11 and the abutting portion 9*a* of the locking member 9.

Further, a concave portion 6*a* is formed on the upper surface of the roller bearing support member 6 (cassette rail 3) so that the roller bearing support member 6 (cassette rail 3) does not abut against the inner rail 8 when the sheet cassette 2 is lifted in such a manner.

For example, in the case where the image forming apparatus is placed in a low position, when a user tries to pull out the sheet cassette 2, the user needs to grip a handle of the sheet cassette 2 to pull out the sheet cassette 2 as it is tilted. Here, in the case of such a structure of the drawer apparatus, when the user tries to pull out the sheet cassette 2 as it is tilted, the locking claw 11 of the sheet cassette 2 does not abut against the locking member 9 of the inner rail 8 as shown in FIG. 8 and the sheet cassette 2 is drawn out.

An example of the structure for solving such problems includes a structure having a stop member which allows the sheet cassette 2 to be stopped at a predetermined drawing position without drawing out when the sheet cassette 2 is pulled out. The technique is disclosed in Japanese Patent No. 3571910.

However, in the case of conventional image forming apparatuses having such a stop member, when the user draws out the sheet cassette, the stop member has to be moved from the position where the sheet cassette is stopped at the drawing position to the position where the sheet cassette can be drawn out.

When the drawn out sheet cassette is mounted, the stop member has to be moved from the position where the sheet cassette can be drawn out to the position where the sheet cassette is stopped at the drawing position. Therefore, when the sheet cassette is drawn out or mounted, the operation is complicated.

SUMMARY OF THE INVENTION

The present invention has been achieved in view of the above circumstances and there is provided an image forming apparatus in which the sheet cassette can be reliably pull out and the sheet cassette can be easily drawn out and mounted.

According to the present invention, there is provided an image forming apparatus having a sheet cassette which is drawably mounted onto a cassette housing portion which includes a rail member provided on the inner wall surface of the cassette housing portion, an engaging portion which is formed on the wall surface of the side in a direction perpendicular to the pull out direction of the sheet cassette and engages with the rail member so that the sheet cassette is moved along the rail member while the movement in a sliding direction is regulated by the rail member, and a limitation member which is provided at the engaging portion of the sheet cassette so as to be able to abut against the rail member in the sliding direction and limits the inclination in the sliding direction to the rail member of the sheet cassette when the sheet cassette is moved along the rail member, where the limitation of the inclination of the sheet cassette by the limitation member is released when the sheet cassette is pulled out.

Further features of the present invention will become apparent from the following description of exemplary embodiments with reference to the attached drawings.

DESCRIPTION OF THE EMBODIMENTS

Hereinafter, an exemplary embodiment of the present invention will be specifically described with reference to the drawings.

Figure 1:
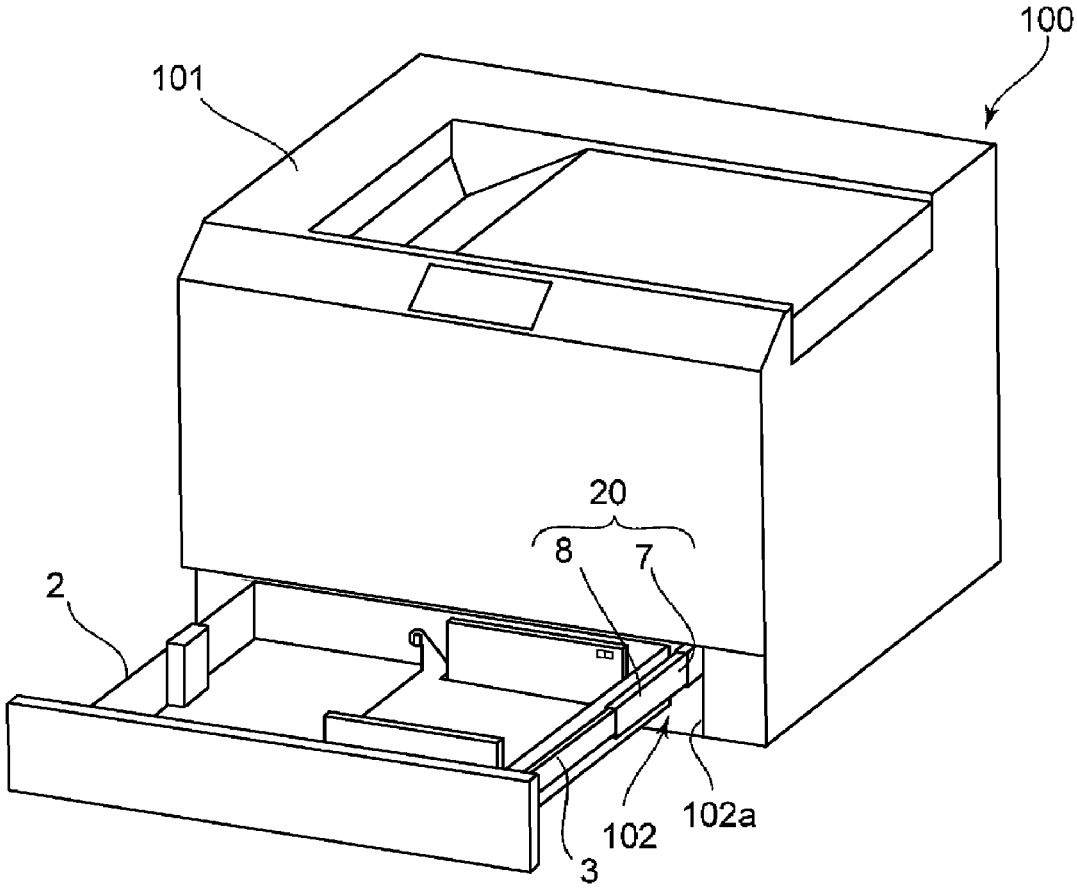
FIG. 1 is a perspective view of the image forming apparatus according to the embodiment of the present invention.

FIG. 1 is a perspective view of the image forming apparatus according to the embodiment of the present invention. An image forming apparatus 100 and a main body of the image forming apparatus 101 (hereinafter referred to as the main body of the apparatus) are shown in FIG. 1. The image forming portion (not shown) and a sheet feeding apparatus (not shown) which feeds the sheet housed in the sheet cassette 2 which is drawably mounted in the main body of the apparatus 101 to the image forming portion are provided in the main body of the apparatus 101.

In FIG. 1, a cassette housing portion is formed on the lower side of the main body of the apparatus 101. As shown in FIG. 1, when the sheet is housed or supplied, the sheet cassette 2 housed in the cassette housing portion 102 is pull out toward the front side of the main body of the apparatus 101.

The frame rail 20 which includes the outer rail 7 fixed to the inner wall surface 102*a* and the inner rail 8 slidably held at the outer rail 7 and guides the drawing and mounting of the sheet cassette 2 is provided at the inner wall surface 102*a* of the cassette housing portion 102. In this regard, the frame rail 20 is formed on the other inner wall surface (not shown) opposed to one side of the inner wall surface 102*a* of the cassette housing portion 102.

The cassette rail 3 which is provided opposite to the frame rail 20 and serves as a guide when the sheet cassette 2 is pulled out is formed on the wall surface of both sides in a direction perpendicular to the pull out direction of the sheet cassette 2.

The drawer apparatus drawably mounts the sheet cassette 2 in the main body of the apparatus 101 with the frame rail 20 provided at the inner wall surface 102*a* of the cassette housing portion 102 and the cassette rail 3 provided at the sheet cassette 2.

When the sheet is housed in the sheet cassette 2 by the drawer apparatus, the sheet cassette 2 can be pulled out to the position where the sheet can be housed. In the drawer apparatus, when the sheet cassette 2 is drawn out, the downstream (front) in the pull out direction of the sheet cassette 2 is pulled upward after pulling out the sheet cassette 2 and then drawn out obliquely upward.

Figure 2:
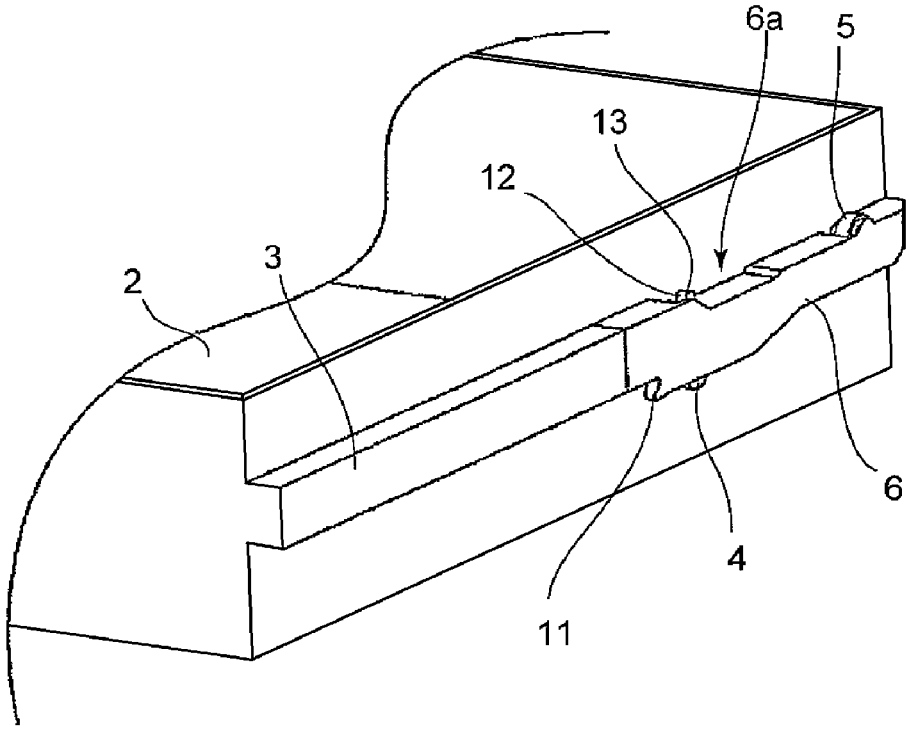
FIG. 2 is a perspective view illustrating the structure of the drawer apparatus formed in the image forming apparatus.
Figure 3:
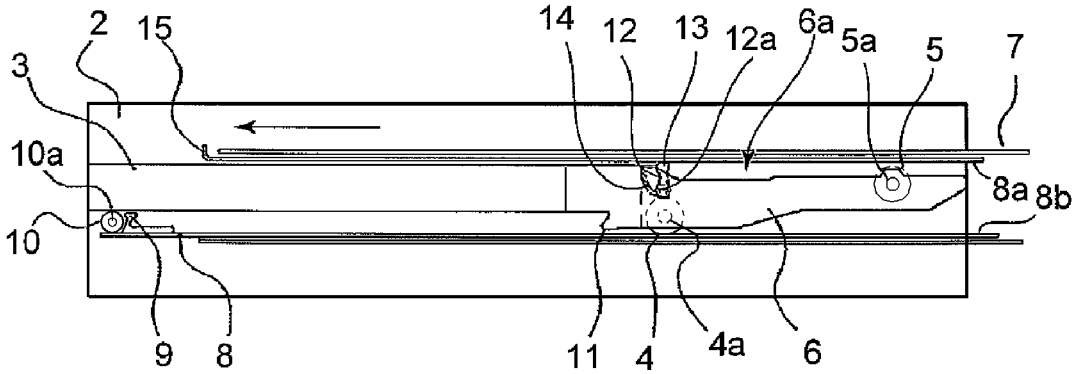
FIG. 3 is a side view illustrating the condition that the sheet cassette of the drawer apparatus is housed.
Figure 7:
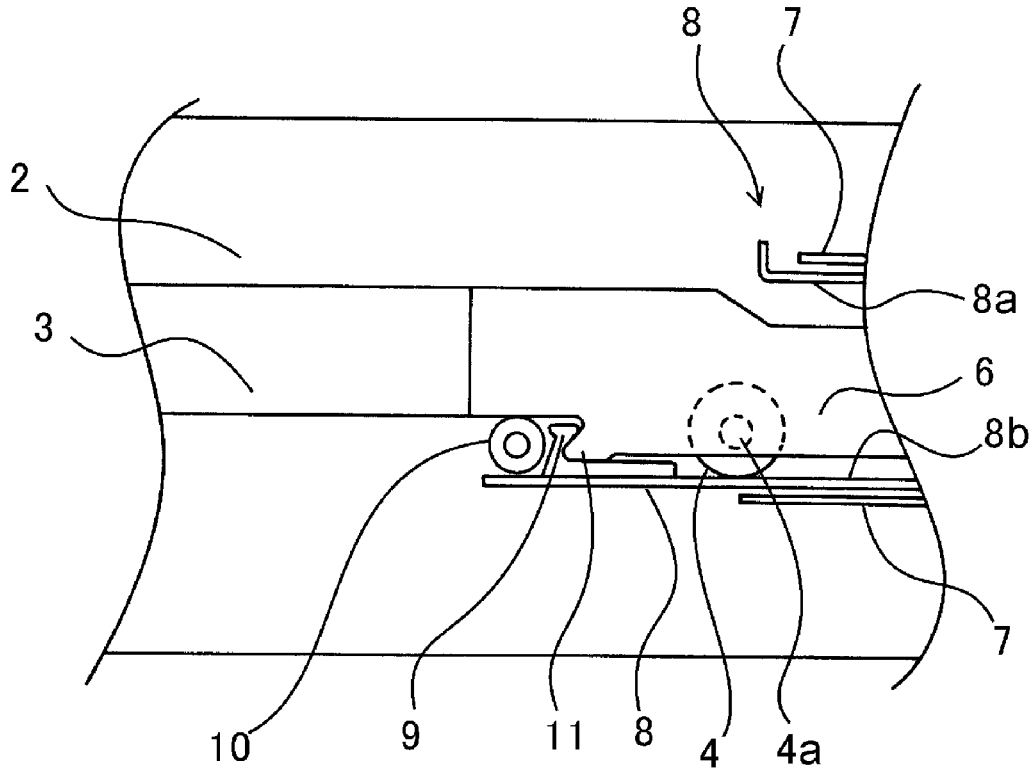
FIG. 7 is a view illustrating the condition that the sheet cassette of the conventional drawer apparatus is pulled out from the main body of the apparatus.
Figure 8:
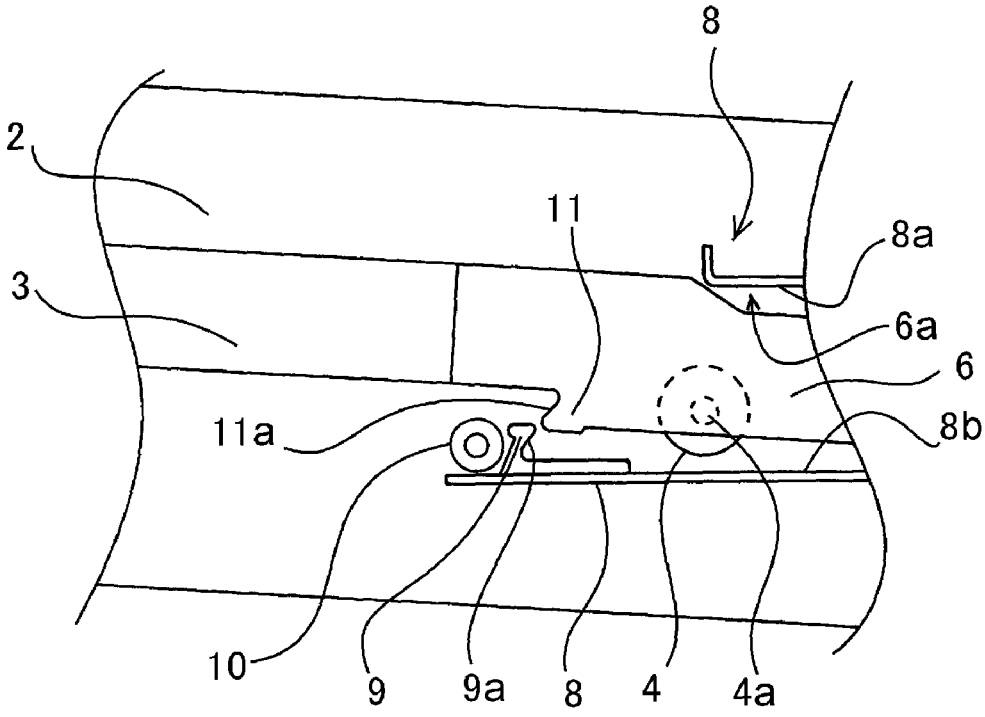
FIG. 8 is a view illustrating the condition that the sheet cassette of the conventional drawer apparatus is taken out from the main body of the apparatus.

FIG. 2 is a perspective view illustrating such a structure of the drawer apparatus. FIG. 3 is a side view illustrating the condition that the sheet cassette 2 of the drawer apparatus is housed. The same symbols as those used in FIG. 7 are assigned to the same portions as or equivalent portions to those shown in FIGS. 2 and 3.

In FIGS. 2 and 3, a swing lever 12 is a limitation member which limits the inclination in the sliding direction to the inner rail 8 of the sheet cassette 2 when the sheet cassette 2 is moved. The swing lever 12 is held the roller bearing support member 6 provided at the sheet cassette 2 so as to be able to swing on an axis 12*a*.

An abutting portion 13 in which the top end is protruded from the concave portion 6*a* which is provided so that the upper surface of the roller bearing support member 6 is dented to the side of the upper guide surface of the inner rail 8 and which can abut the upper guide surface 8*a* of the inner top of the inner rail 8 is provided at the swing lever 12. Further, an elastic portion 14 which applies a force to the direction that the abutting portion 13 is protruded from the roller bearing support member 6 is integrally formed at the swing lever 12. In this regard, elastic members such as coil springs may be connected for use without integrally forming the elastic portion.

The swing lever 12 is welded to an abutting wall (not shown) which is provided at the roller bearing support member 6 by elasticity of the elastic portion 14. Usually, the swing lever 12 is elastically held at the first position in the condition that the abutting portion 13 is protruded from the upper surface of the roller bearing support member 6. In the condition that the sheet cassette 2 is mounted in the cassette housing portion 102, the swing lever 12 is in the first position. For that reason, even if an upward lifting force is applied to the sheet cassette 2, the abutting portion 13 of the swing lever 12 abuts against the upper guide surface 8*a* of the inner rail 8. Accordingly, the movement upward (inclination) of the sheet cassette 2 is limited.

That is, the flat surface of the upper portion of the abutting portion 13 of the swing lever 12 is located at the upper portion of the axis 12*a* and formed parallel to the upper guide surface 8*a*. Thus, even if the flat surface of the upper portion of the abutting portion 13 abuts against the upper guide surface 8*a*, the swing lever 12 cannot be swung. For that reason, the swing lever 12 abuts against the upper guide surface 8*a* and an upward inclination of the upper portion of the sheet cassette 2 is limited.

The swing lever 12 in the condition that the abutting portion 13 is protruded from the roller bearing support member 6 is provided at the sheet cassette 2 in such a manner. Therefore, in pulling out the sheet cassette 2, the movement upward (inclination) of the sheet cassette 2 is limited even if the upward lifting force is applied to the sheet cassette 2.

When the user tries to take out the sheet cassette 2 as it is tilted after pulling out the sheet cassette 2 to the drawing position as described below, the swing lever 12 is swung against an elastic force of the elastic portion 14 and moved to the second position where the abutting portion 13 is retracted from the upper surface of the roller bearing support member 6. Thus, even if the swing lever 12 is provided, the sheet cassette 2 can be detached (drawn out).

Subsequently, such an operation of the swing lever 12 when the sheet cassette 2 is pulled out will be described.

In order to pull out the sheet cassette 2, when the sheet cassette 2 is moved in a direction pulled out from the main body of the apparatus 101, namely, in the direction of an arrow in FIG. 3, the swing lever 12 is held at the first position by the elastic portion 14.

Thus, even when the upward lifting force is applied to the sheet cassette 2 in the middle of pulling out the sheet cassette 2, the abutting portion 13 of the swing lever 12 abuts against the upper guide surface 8*a* of the inner rail 8. Consequently, the movement upward of the sheet cassette 2 is limited. Thus, even when the upward lifting force is applied to the sheet cassette 2 in the middle of pulling out the sheet cassette 2, the sheet cassette 2 moves along the inner rail 8 without inclining in the sliding direction and lifting the downstream in the pull out direction.

Figure 4:
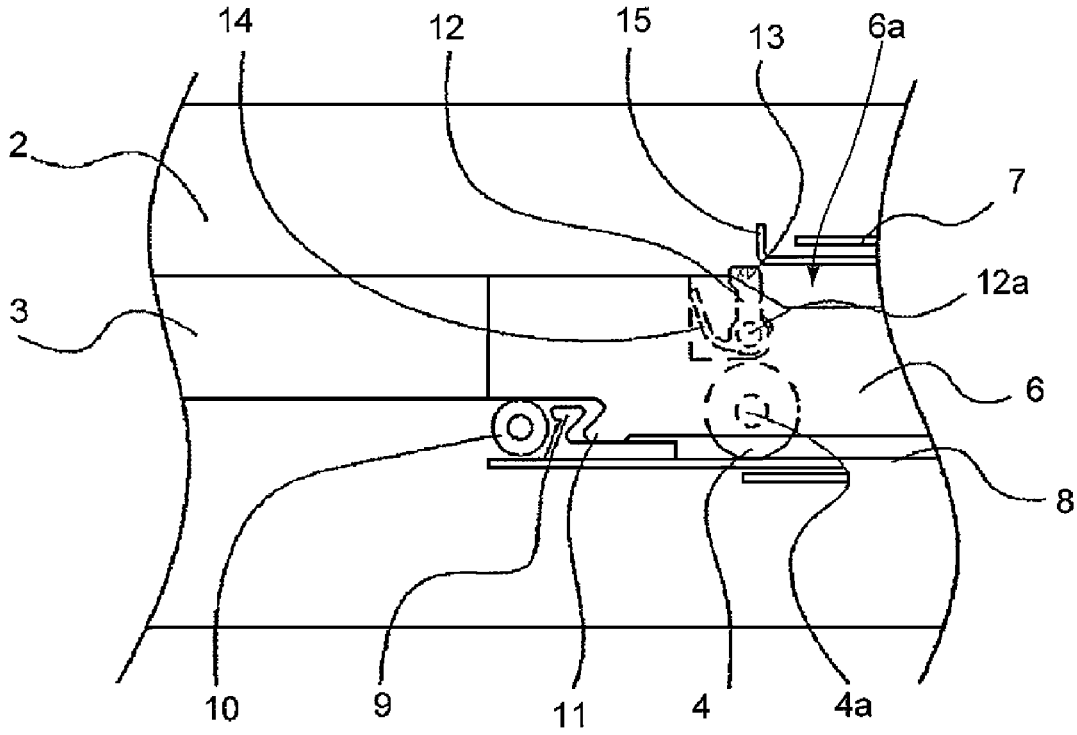
FIG. 4 is a view illustrating the condition that the sheet cassette of the drawer apparatus is pulled out from the main body of the apparatus.

In this regard, FIG. 4 is a view illustrating the condition of the drawer apparatus when the sheet cassette 2 is pulled out from the main body of the apparatus 101. As shown in FIG. 4, when the sheet cassette 2 is pulled out from the main body of the apparatus 101 the locking claw 11 of the roller bearing support member 6 is locked by the locking member 9 of the inner rail 8. Thus, the sheet cassette 2 can be stopped at the predetermined drawing position.

At this time, the swing lever 12 is located at the downstream in the pull out direction that is lower than the downstream end of the inner rail 8 in the pull out direction. The swing lever 12 and the inner rail 8 are set so that contact between the abutting portion 13 of the swing lever 12 and the upper guide surface 8*a* of the inner rail 8 can be ensured until when the sheet cassette 2 is pulled out. Thus, the sheet cassette 2 will not be inclined and will not be drawn out from the main body of the apparatus 101 despite the user's intent until the sheet cassette 2 is pulled out from the main body of the apparatus 101.

Subsequently, effects of the swing lever 12 when the user draws out the sheet cassette 2 from the main body of the apparatus 101 will be described.

Figure 5A:
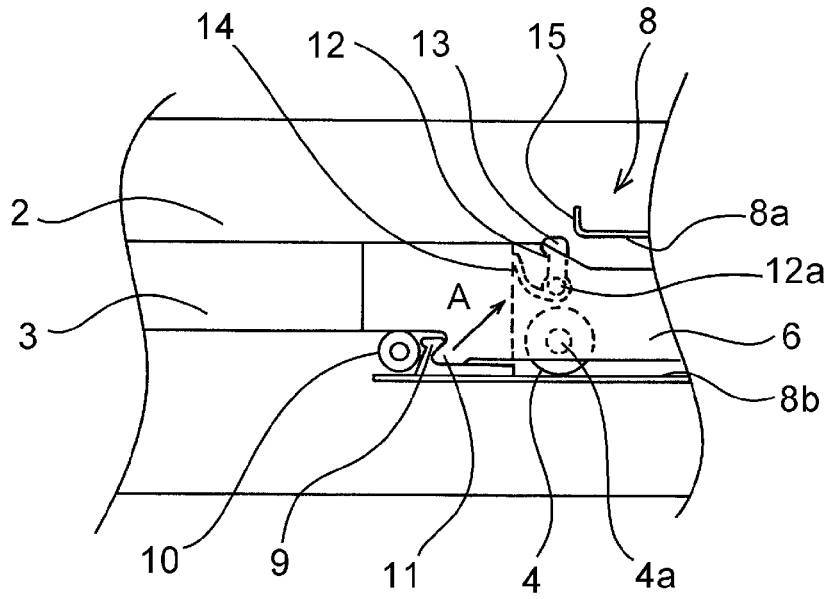
FIGS. 5A and 5B are views illustrating the condition that the sheet cassette of the drawer apparatus is taken out from the main body of the apparatus.

In the case where the sheet cassette 2 is detached from the main body of the apparatus 101, the sheet cassette 2 is lifted. Thus, the sheet cassette 2 is moved in the direction of an arrow A by the inclination of each of the abutting portions 9*a* and 11*a* of the locking member 9 of the inner rail 8 and the locking claw 11 of the roller bearing support member 6 as shown in FIG. 5A. Then, the engagement of the locking claw 11 of the roller bearing support member 6 and the locking member 9 of the inner rail 8 is separated.

Figure 5B:
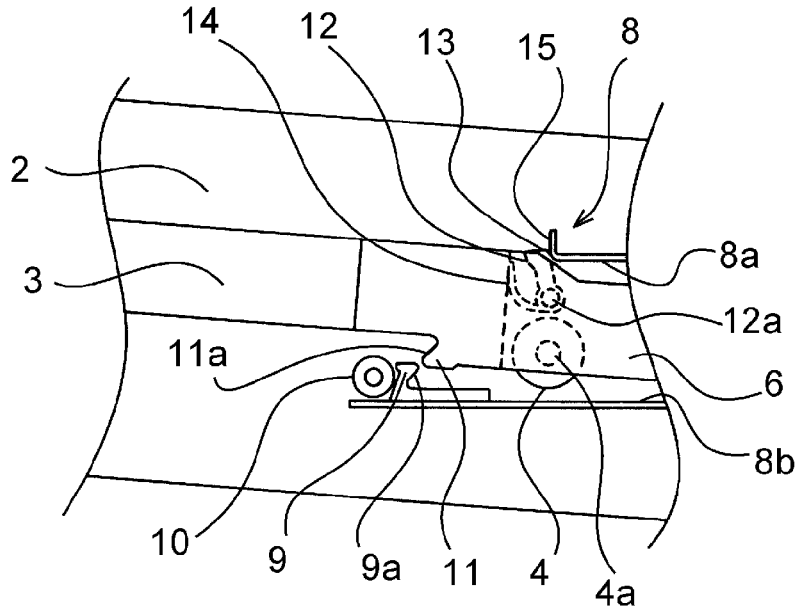
Figure 6:
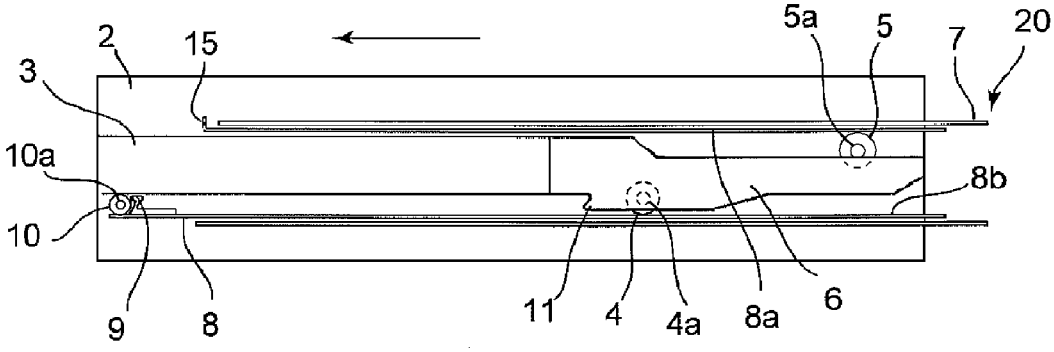
FIG. 6 is a view illustrating the structure of a conventional drawer apparatus formed in the image forming apparatus.

In this case, the abutting portion 13 of the swing lever 12 which is protruded from the concave portion 6*a* formed on the upper surface of the roller bearing support member 6 abuts against a downstream end 15 of the inner rail 8 in the pull out direction as shown in FIG. 5B.

Since the side surface of the abutting portion 13 abuts against the side end 15 of the inner rail 8, the swing lever 12 is swung against the elastic force of the elastic portion 14 in a counterclockwise direction and then moved to the second position where the abutting portion 13 is retracted from the upper surface of the roller bearing support member 6. As a result, the sheet cassette 2 can be taken out obliquely upward (drawn out) from the main body of the apparatus 101 without being interfered by the swing lever 12.

In the case where the sheet cassette 2 is mounted, the sheet cassette 2 is inserted into the side of the main body of the apparatus while the sheet cassette 2 is inclined and the cassette rail 3 of the sheet cassette 2 is engaged with the inner rail 8. At this time, the abutting portion 13 abuts against the inner rail 8, the swing lever 12 is swung against the elastic force of the elastic portion 14 in the counterclockwise direction and thus the abutting portion 13 is retracted from the upper surface of the roller bearing support member 6. As a result, the sheet cassette 2 can be inserted into the main body of the apparatus 101 without being interfered by the swing lever 12.

Thus, the sheet cassette 2 can be reliably pulled out by limiting the inclination of the sheet cassette 2 when the sheet cassette 2 is moved and releasing the control of the inclination of the sheet cassette 2 when the sheet cassette 2 is pulled out. Further, the sheet cassette 2 can be easily drawn out and mounted.

In this regard, the case where the abutting portion 13 of the swing lever 12 is protruded from the upper surface of the roller bearing support member 6 has been described. However, the present invention is not limited thereto. The same effect can be obtained, for example, when a swing lever having an abutting portion which is protruded downward from the roller bearing support member 6 is provided at the roller bearing support member 6 so as to freely projects and be retracted and the abutting portion is protruded through an inner rail side (rail member side) in moving the sheet cassette 2.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-226362, filed Aug. 31, 2007, which is hereby incorporated by reference herein in its entirety.

What is claimed is:

1. An image forming apparatus having a sheet cassette which is drawably mounted onto a cassette housing portion comprising:

a rail member provided on the inner wall surface of the cassette housing portion;

a locking portion which is provided at said rail member and which stops the sheet cassette in a pull out direction and releases the stop of the sheet cassette when the sheet cassette is lifted;

an engaging portion which is formed on a wall surface of the side of the sheet cassette in a direction perpendicular to the pull out direction of the sheet cassette and engages with said rail member so that the sheet cassette is moved along said rail member; and a limitation member which is provided at said engaging portion of the sheet cassette and which abuts against said rail member and limits the inclination of the sheet cassette when the sheet cassette is moved along said rail member, wherein when the sheet cassette is moved along said rail member, said limitation member protrudes to abut against said rail member, and when the sheet cassette is taken out from the cassette housing portion or mounted onto the cassette housing portion, while the sheet cassette is lifted, said limitation member is retracted into the inside of said engaging portion.

2. The image forming apparatus according to claim 1, wherein said limitation member is located at a position downstream in the pull out direction, that is lower than the downstream end of said rail member when the sheet cassette is pulled out.

3. The image forming apparatus according to claim 1, further comprising:

a pull-out stop portion which is formed in the downstream end of said engaging portion of the sheet cassette in the pull out direction and abuts against said locking portion of said rail member to stop the sheet cassette when the sheet cassette is pulled out, wherein said limitation member is located at a position downstream in the pull out direction, that is lower than the downstream end of said rail member when said pull-out stop portion abuts against said locking portion of said rail member.

4. The image forming apparatus according to claim 1, further comprising roller bearing members provided at said engaging portion which is rotated along said rail member.

* * * * *